US007168947B2

(12) United States Patent
Zamansky et al.

(10) Patent No.: US 7,168,947 B2
(45) Date of Patent: Jan. 30, 2007

(54) METHODS AND SYSTEMS FOR OPERATING COMBUSTION SYSTEMS

(75) Inventors: Vladimir M. Zamansky, Oceanside, CA (US); Vitali Victor Lissianski, San Juan Capistrano, CA (US); Boris Nickolaevich Eiteneer, Aliso Viejo, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/885,267

(22) Filed: Jul. 6, 2004

(65) Prior Publication Data

US 2006/0008757 A1 Jan. 12, 2006

(51) Int. Cl.
*F23C 7/00* (2006.01)
*F23C 99/00* (2006.01)

(52) U.S. Cl. ..... 431/10; 431/2; 431/4; 431/8

(58) Field of Classification Search ..... 431/2, 431/4, 7, 8, 10, 170; 110/342, 343, 344, 110/345; 60/723, 732, 733; 423/235
See application file for complete search history.

(56) References Cited

U.S. PATENT DOCUMENTS 3,873,671 A * 3/1975 Reed et al. ..... 423/235
3,911,083 A * 10/1975 Reed et al. ..... 423/235
4,118,171 A * 10/1978 Flanagan et al. ..... 431/10
4,329,932 A * 5/1982 Takahashi et al. ..... 110/347
4,343,606 A * 8/1982 Blair et al. ..... 431/10
4,354,821 A * 10/1982 Kesselring et al. ..... 431/7
4,403,941 A * 9/1983 Okiura et al. ..... 431/10
4,427,362 A * 1/1984 Dykema ..... 431/4
4,459,126 A * 7/1984 Krill et al. ..... 431/7
4,519,993 A * 5/1985 McGill et al. ..... 423/235
4,585,632 A * 4/1986 Schneider et al. ..... 423/239.1
4,721,454 A * 1/1988 Schirmer et al. ..... 431/10
4,851,201 A * 7/1989 Heap et al. ..... 423/235
4,877,590 A * 10/1989 Epperly et al. ..... 423/235
4,878,830 A * 11/1989 Henderson ..... 431/10
5,139,755 A * 8/1992 Seeker et al. ..... 423/235
5,291,841 A * 3/1994 Dykema ..... 110/347
5,411,394 A * 5/1995 Beer et al. ..... 431/9
5,413,477 A * 5/1995 Moreland ..... 431/9
5,510,092 A * 4/1996 Mansour et al. ..... 423/239.1
5,531,973 A * 7/1996 Sarv ..... 423/235

(Continued)

FOREIGN PATENT DOCUMENTS

EP 000626543 A1 * 11/1994

(Continued)

*Primary Examiner*—Carl D. Price
(74) *Attorney, Agent, or Firm*—Armstrong Teasdale LLP

(57) ABSTRACT

Methods and systems for reducing nitrogen oxides in combustion flue gas is provided. The method includes combusting a fuel in a main combustion zone such that a flow of combustion flue gas is generated wherein the combustion flue gas includes at least one nitrogen oxide species, establishing a fuel-rich zone, forming a plurality of reduced N-containing species in the fuel rich zone, injecting over-fire air into the combustion flue gas downstream of fuel rich zone, and controlling process parameters to provide conditions for the reduced N-containing species to react with the nitrogen oxides in the OFA zone to produce elemental nitrogen such that a concentration of nitrogen oxides is reduced.

31 Claims, 8 Drawing Sheets

U.S. PATENT DOCUMENTS

| | | | | | |
|---|---|---|---|---|---|
| 5,617,715 | A | * | 4/1997 | Beer et al. | 60/783 |
| 5,707,596 | A | * | 1/1998 | Lewandowski et al. | 423/235 |
| 5,725,366 | A | * | 3/1998 | Khinkis et al. | 431/10 |
| 5,746,144 | A | * | 5/1998 | Breen et al. | 110/345 |
| 5,756,059 | A | | 5/1998 | Zamansky et al. | |
| 5,823,124 | A | * | 10/1998 | Koppang | 110/345 |
| 5,878,700 | A | * | 3/1999 | Farzan et al. | 122/4 D |
| 6,058,855 | A | * | 5/2000 | Ake et al. | 110/214 |
| 6,066,303 | A | * | 5/2000 | Sudduth et al. | 423/235 |
| 6,085,674 | A | * | 7/2000 | Ashworth | 110/347 |
| 6,206,685 | B1 | * | 3/2001 | Zamansky et al. | 431/4 |
| 6,213,032 | B1 | * | 4/2001 | Breen et al. | 110/345 |
| 6,280,695 | B1 | | 8/2001 | Lissianski et al. | |
| 6,325,002 | B1 | * | 12/2001 | Ashworth | 110/345 |
| 6,394,790 | B1 | * | 5/2002 | Kobayashi | 431/10 |
| 6,471,506 | B1 | | 10/2002 | Zamansky et al. | |
| 6,474,271 | B1 | | 11/2002 | Widmer et al. | |
| 6,638,061 | B1 | | 10/2003 | Cain et al. | |
| 6,694,900 | B2 | | 2/2004 | Lissianski et al. | |
| 6,699,030 | B2 | * | 3/2004 | Bool et al. | 431/10 |
| 6,706,246 | B2 | | 3/2004 | Hopkins et al. | |
| 6,718,772 | B2 | | 4/2004 | Dalla Betta et al. | |
| 2005/0058958 | A1 | * | 3/2005 | Kobayashi et al. | 431/10 |
| 2005/0103243 | A1 | * | 5/2005 | Lissianski et al. | 110/345 |

FOREIGN PATENT DOCUMENTS

| | | | |
|---|---|---|---|
| EP | 000554250 B1 | * | 3/1995 |
| GB | 2 071 832 | * | 9/1981 |
| GB | 2 146 113 | * | 4/1985 |
| JP | 53-45725 | * | 4/1978 |
| JP | 54-40277 | * | 3/1979 |
| JP | 54-50470 | * | 4/1979 |
| JP | 54-50471 | * | 4/1979 |
| JP | 54-95020 | * | 7/1979 |
| JP | 56-68707 | * | 6/1981 |
| JP | 57-35925 | * | 2/1982 |
| JP | 57-71624 | * | 5/1982 |
| JP | 58-3 | * | 1/1983 |
| JP | 58-164911 | * | 9/1983 |
| JP | 58-187710 | * | 11/1983 |
| JP | 58-187712 | * | 11/1983 |
| JP | 58-198606 | * | 11/1983 |
| JP | 59-9413 | * | 1/1984 |
| JP | 59-115904 | * | 7/1984 |
| JP | 60-96814 | * | 5/1985 |
| JP | 62-87707 | * | 4/1987 |
| JP | 01-150707 | * | 1/1989 |
| JP | 03-50407 | * | 3/1991 |
| JP | 11-76752 | * | 3/1999 |
| WO | WO 98/54513 | * | 12/1998 |
| WO | WO 99/06765 | * | 2/1999 |

* cited by examiner

METHODS AND SYSTEMS FOR OPERATING COMBUSTION SYSTEMS

BACKGROUND OF THE INVENTION

This invention relates generally to operating combustion systems and, more particularly, to methods and systems for operating combustion systems to facilitate reducing $NO_x$ emissions.

Typical boilers, furnaces, engines, incinerators, and other combustion sources emit exhaust gases that include nitrogen oxides. Nitrogen oxides include nitric oxide (NO), nitrogen dioxide ($NO_2$), and nitrous oxide ($N_2O$). Total $NO+NO_2$ concentration is usually referred to as $NO_x$. Nitrogen oxides produced by combustion are mainly in the form of NO. Some $NO_2$ and $N_2O$ are also formed, but their concentrations are generally less than approximately 5% of the NO concentration, which generally ranges from 200 to 1000 ppm for coal-fired applications. Nitrogen oxide emissions are the subject of growing concern because they are alleged to be toxic compounds and precursors to acid rain and photochemical smog, and contributors to the greenhouse effect.

Several commercial technologies are available to reduce $NO_x$ emissions from combustion sources. Currently, Selective Catalytic Reduction (SCR) is a commercial technology that is frequently used to facilitate $NO_x$ control. With SCR, $NO_x$ is reduced by reactions with Nitrogen Reducing Agents (N-agents, such as ammonia, urea, etc.) across the surface of a catalyst. Known SCR systems operate at temperatures of approximately 700° F. and routinely are able to achieve approximately 80% $NO_x$ reduction. However, several inherent drawbacks of SCR, and most importantly, its high cost, may prevent it from being an all-encompassing solution to the problem of $NO_x$ removal. Moreover, SCR requires the installation of a large amount of catalyst in the exhaust stream, and SCR catalyst life is limited. Specifically, catalyst deactivation, due to a number of mechanisms, generally limits catalyst life to about four years for coal-fired applications. Costs associated with system modifications, installation and operation, combined with the cost of catalyst material, render SCR quite expensive pollutant control technology. Furthermore, because the spent catalysts are toxic, the catalysts also present disposal problems at the end of lifetime.

To facilitate reducing costs compared to the SCR technology, the reaction of N-agents with $NO_x$ can proceed without a catalyst at a higher temperature. This process is called the Selective Non-Catalytic Reduction (SNCR). SNCR is effective over a narrow range of temperatures, or "temperature window" centered about 1800° F. wherein the N-agent forms $NH_i$ radicals that react with NO. Under ideal laboratory conditions, deep $NO_x$ control may be possible; however, in practical full-scale installations, the non-uniformity of the temperature profile, difficulties of mixing the N-agent across the full combustor cross section, limited residence time for reactions, and ammonia slip (unreacted N-agent) may limit SNCR's effectiveness. Generally, $NO_x$ control via SNCR is limited to between approximately 40% and approximately 50%. However, since SNCR does not require a catalyst and therefore has a relatively lower capital cost compared to SCR, it is a valuable option for $NO_x$ control with a lower efficiency of $NO_x$ control compared to SCR systems.

Other known combustion systems include combustion modifications such as Low $NO_x$ Burners (LNB), reburning, and over-fire air (OFA) injection control of $NO_x$ emissions via combustion staging. These technologies provide relatively moderate $NO_x$ control of between approximately about 30% and approximately 60%. However, their capital costs are low and, since no injection of N-agents is required, their operating costs are generally reduced in comparison to SCR or SNCR systems. $NO_x$ control in reburning is achieved by fuel staging wherein a main portion of the fuel, for example, approximately 80% to approximately 90% is fired through the conventional burners with a normal amount of air, for example, approximately 10% excess. A certain amount of $NO_x$ is formed during the combustion process, and in a second stage, the remainder of the fuel (reburn fuel) is added into the secondary combustion zone, called the reburn zone, to maintain a fuel-rich environment. The reburn fuel can be coal, gas or other fuels. In the reducing atmosphere within the fuel-rich zone, both $NO_x$ formation and $NO_x$ removal reactions occur. Experimental results indicate that within a specific range of conditions (equivalence ratio, temperature, and residence time in the reburn zone), $NO_x$ concentrations may typically be reduced by approximately 50% to approximately 60%. Part of the reburn fuel is rapidly oxidized by oxygen to form CO and hydrogen, and the remaining reburn fuel provides a fuel-rich mixture with certain concentrations of carbon-containing radicals: $CH_3$, $CH_2$, CH, C, HCCO, etc. These active species can either form NO precursors in reactions with molecular nitrogen or consume NO in direct reactions with it. Many elementary reaction steps are involved in NO reduction. The carbon-containing radicals ($CH_i$) formed in the reburn zone are capable of reducing NO concentrations by converting it into various intermediate species with C—N bonds. These species, in turn, are converted into $NH_i$ species ($NH_2$, NH, and N), which later react with NO to form molecular nitrogen. Thus, NO can be removed by reactions with two types of radicals, namely species: $CH_i$ and $NH_i$. However, reactions of intermediate N-containing species with NO are typically slow in the absence of $O_2$ and do not contribute significantly to NO reduction in the reburn zone. In the third stage OFA is injected to complete combustion of the fuel. Typically OFA is injected at a location where the flue gas temperature is about 1800° F. to about 2800° F. to facilitate achieving complete combustion. The temperature of the flue gas at a point where overfire air is injected is henceforth referred to as $T_{OFA}$. The OFA added in the last stage of the process oxidizes remaining CO, $H_2$, HCN, and $NH_i$ species as well as unreacted fuel and fuel fragments, to final products, which include $H_2O$, $N_2$, and $CO_2$. At this stage, the reduced N-containing species react mainly with oxygen and are oxidized either to elemental nitrogen or to $NO_x$. It is the undesired oxidation of N-containing species to $NO_x$ that limits the efficiency of the reburning process.

Generally, reburning fuel is injected at flue gas temperatures of about 2300° F. to about 3000° F. The efficiency of $NO_x$ reduction in reburning may increase with an increase in injection temperature because of faster oxidation of the reburning fuel at higher temperatures, resulting in higher concentrations of carbon-containing radicals involved in $NO_x$ reduction. For reburning fuel heat inputs up to about 20%, the efficiency of $NO_x$ reduction increases with an increase in the amount of the reburning fuel. With larger amounts of reburning fuel, the efficiency of $NO_x$ reduction flattens out and may even slightly decrease. Increasing residence time in the reburn zone also improves reductions in nitrogen oxides emissions by allowing more time for reburning chemistry to proceed.

Lastly, an Advanced Reburning (AR) process, which is a synergistic integration of reburning and SNCR, is also currently available. Using AR, the N-agent is injected along with the OFA and the reburning system is adjusted to facilitate optimizing $NO_x$ reduction with an N-agent. By adjusting the reburning fuel injection rate to achieve near-stoichiometric conditions, instead of fuel-rich conditions normally used for reburn, the CO level is facilitated to be controlled, and the temperature window for effective SNCR chemistry may be broadened. With AR, $NO_x$ reduction achieved from the N-agent injection is nearly doubled, compared with that of SNCR. Furthermore, with AR, the widening of the temperature window provides flexibility in locating the injection system and the $NO_x$ control should be achievable over a broad boiler operating range.

However, although the technologies described above are available and capable of reducing $NO_x$ concentrations from combustion sources, they are complex systems that are also expensive to install, operate, and maintain.

BRIEF DESCRIPTION OF THE INVENTION

In one embodiment, a method for reducing nitrogen oxides in combustion flue gas is provided. The method includes combusting a fuel in a main combustion zone such that a flow of combustion flue gas is generated wherein the combustion flue gas includes at least one nitrogen oxide species, establishing a fuel-rich zone, forming a plurality of reduced N-containing species in the fuel rich zone, injecting over-fire air into the combustion flue gas downstream of fuel rich zone, and controlling process parameters to provide conditions for the reduced N-containing species to react with the nitrogen oxides in the OFA zone to produce elemental nitrogen such that a concentration of nitrogen oxides is reduced.

In another embodiment, a furnace having a reduced $NO_x$ emission is provided. The furnace includes a main combustion zone for combusting a fuel, a fuel rich zone located downstream from the main combustion zone, at least one over-fire air port for injecting over-fire air into a combustion flue gas stream at a respective OFA zone, a controller configured to control process conditions in the main combustion zone and the fuel rich zone such that a molar concentration of reduced N-containing species is approximately equal to a molar concentration of $NO_x$ when the combustion flue gas reaches said over-fire air zone.

DETAILED DESCRIPTION OF THE INVENTION

As used herein, the terms "nitrogen oxides" and "$NO_x$" are used interchangeably to refer to the chemical species nitric oxide (NO) and nitrogen dioxide ($NO_2$). Other oxides of nitrogen are known, such as $N_2O$, $N_2O_3$, $N_2O_4$ and $N_2O_5$, but these species are not emitted in significant quantities from stationary combustion sources, except $N_2O$ in some systems. Thus, while the term "nitrogen oxides" can be used more generally to encompass all binary N—O compounds, it is used herein to refer particularly to the NO and $NO_2$ (i.e., $NO_x$) species.

Figure 1:
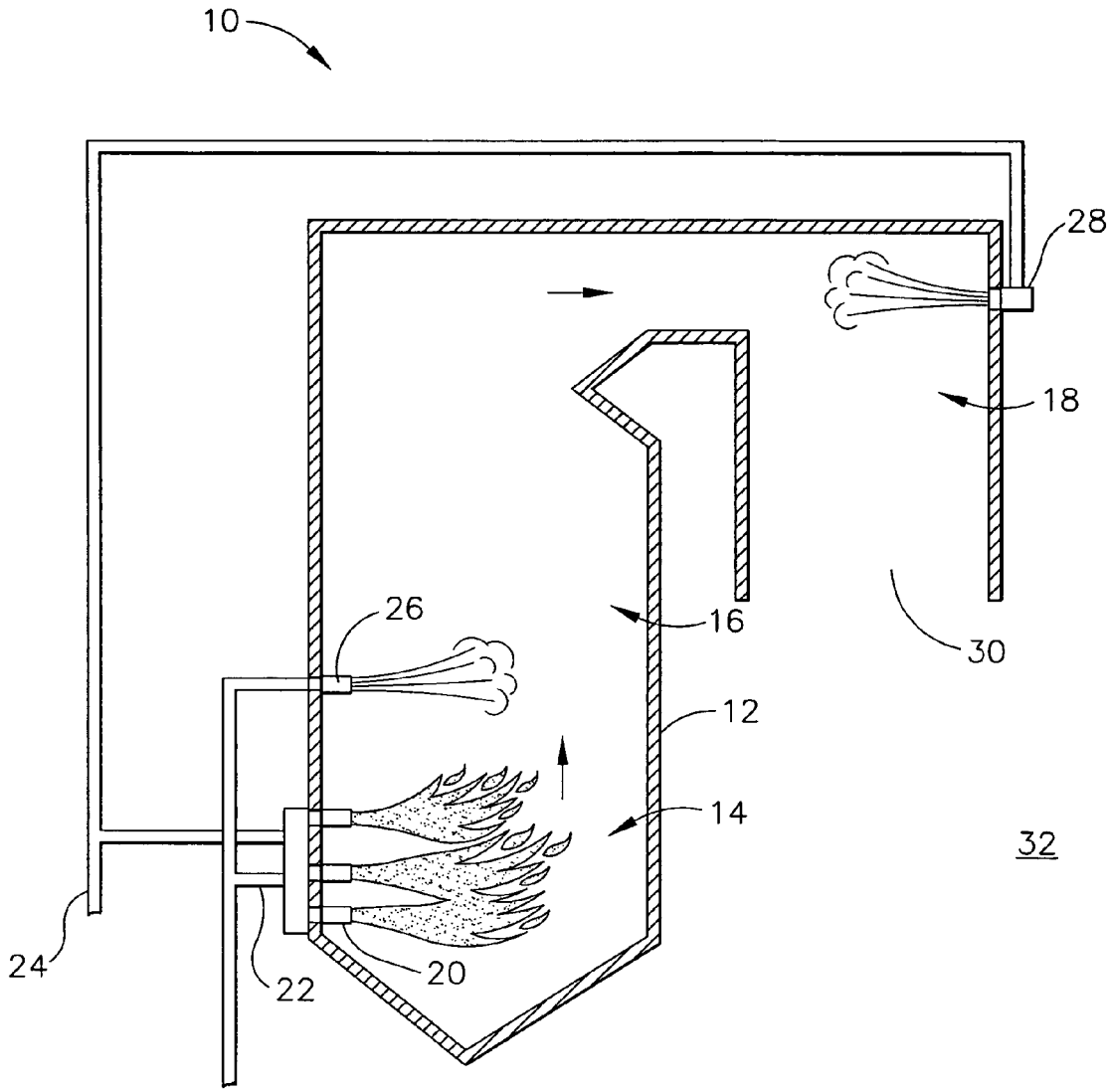
FIG. 1 is a schematic view of a exemplary power generating boiler furnace system.

FIG. 1 is a schematic view of an exemplary power generating boiler system 10 that includes, a furnace 12 including a main combustion zone 14, a reburn zone 16, and a burnout zone 18. Main combustion zone 14 may include a one or more fuel injectors and/or burners 20 that are supplied from a fuel source (not shown) with a predetermined and selectable amount of a fuel 22. In the exemplary embodiment, the fuel source may be, for example, a coal mill and exhauster. In alternative embodiments, the fuel source may be any fossil fuel including oil and natural gas, or any renewable fuel including biomass and waste. Burners 20 may also be supplied with a predetermined and selectable quantity of air 24. Burners 20 may be tangentially arranged in each corner of furnace 12, wall-fired, or have another arrangement.

Reburn zone 16 may be supplied with a predetermined and selectable amount of a fuel 26. Although fuel 22 and fuel 26 are illustrated in FIG. 1 as originating at a common source, it should be understood that fuel 22 and/or fuel 26 may be different types of fuel supplied from separate sources. For example, fuel to burners 20 may be pulverized coal that is supplied from a mill and exhauster, and fuel 26 may be natural gas. Over-fire air (OFA) may be supplied through OFA port 28, from air source 24, or from a separate source (not shown).

During operation, combustion by-products, including various oxides of nitrogen ($NO_x$) may be formed in main combustion zone 14 and carried through furnace 12 to a furnace exhaust flue 30, and ultimately to ambient 32. Removal of the $NO_x$ emissions may be performed using a two-step process, henceforth referred to as in situ advanced reburning (AR) process. During a first step of the process, reburning fuel 26 may be injected into reburn zone 16 to provide a fuel-rich environment in which $NO_x$ is partially reduced to $N_2$. Other reduced N-containing species including $NH_3$ and HCN are formed in reburn zone 16 as a result of this process. An amount of reduced N-containing species formed depends on process conditions in combustion zone 14 and reburn zone 16, and on a chemical composition of main fuel 22 and reburning fuel 26. To facilitate optimizing $NO_x$ reduction using the in-situ-AR process, conditions in main combustion zone 14 and in reburn zone 16 may be selected such that a molar concentration of reduced N-containing species is approximately equal to a $NO_x$ concentration at the point of OFA injection. In one embodiment, conditions in the main combustion zone and the fuel-rich zone are selected to maintain the ratio of molar concentration of reduced N-containing species to the molar concentration of nitrogen oxides in the range of approximately 0.5 to approximately 2.0 when the combustion flue gas reaches location of over-fire air injection. In another embodiment, the ratio is in the range of approximately 0.8 to approximately 1.2 when the combustion flue gas reaches location of over-fire air injection. Reactions between reduced N-containing species such as $NH_3$, HCN, and NO typically proceed relatively slowly in the fuel-rich environment of reburn zone 16. During a second step, OFA may be injected downstream of reburn zone 16. If OFA is injected into NO-containing combustion flue gas within a specific temperature range, a chemical reaction between NO and reduced N-containing species occurs, and NO is converted to molecular nitrogen. The reaction starts with formation of $NH_2$ radicals in reactions of combustion radicals (OH, O and H) with $NH_3$:

$$NH_3+OH \rightarrow NH_2+H_2O,$$

$$NH_3+O \rightarrow NH_2+OH, \text{ and}$$

$$NH_3+H \rightarrow NH_2+H_2.$$

The main elementary reaction of NO-to-$N_2$ conversion is:

$$NH_2+NO \rightarrow N_2+H_2O.$$

Simultaneously, HCN is oxidized to $NH_3$ and N-containing radicals that in turn react with combustion radicals as indicated above. In a conventional SNCR process, reaction between NH-forming reducing agents (N-agents) and NO occurs in a narrow temperature range (temperature window), typically about 1750° F. to about 1950° F. In the in-situ-AR process, oxidation of reburning fuel 26 in reburn zone 16 may not proceed to completion due to the lack of available oxygen. Accordingly, combustion flue gas exiting reburn zone 16 may contain relatively significant concentrations of unburned hydrocarbons, for example, $H_2$ and CO. The presence of these species in the combustion flue gas shifts the conventional SNCR temperature window of $NO_x$ reduction toward lower temperatures. In the in-situ-AR process, the OFA is injected in combustion flue gas at temperatures relatively significantly lower than 1750° F. resulting in relatively significant additional $NO_x$ reduction. In one embodiment, over-fire air is injected into the combustion flue gas at an exhaust gas temperature in a range of between about 900 degrees Fahrenheit to about 2800 degrees Fahrenheit. Downstream of the OFA injection zone the reduced N-containing species react mainly with $NO_x$, producing elemental nitrogen. As such deeper $NO_x$ control is achieved as compared to traditional reburning, where the reduced N-containing species react mainly with oxygen downstream of the OFA injection zone.

Figure 2:
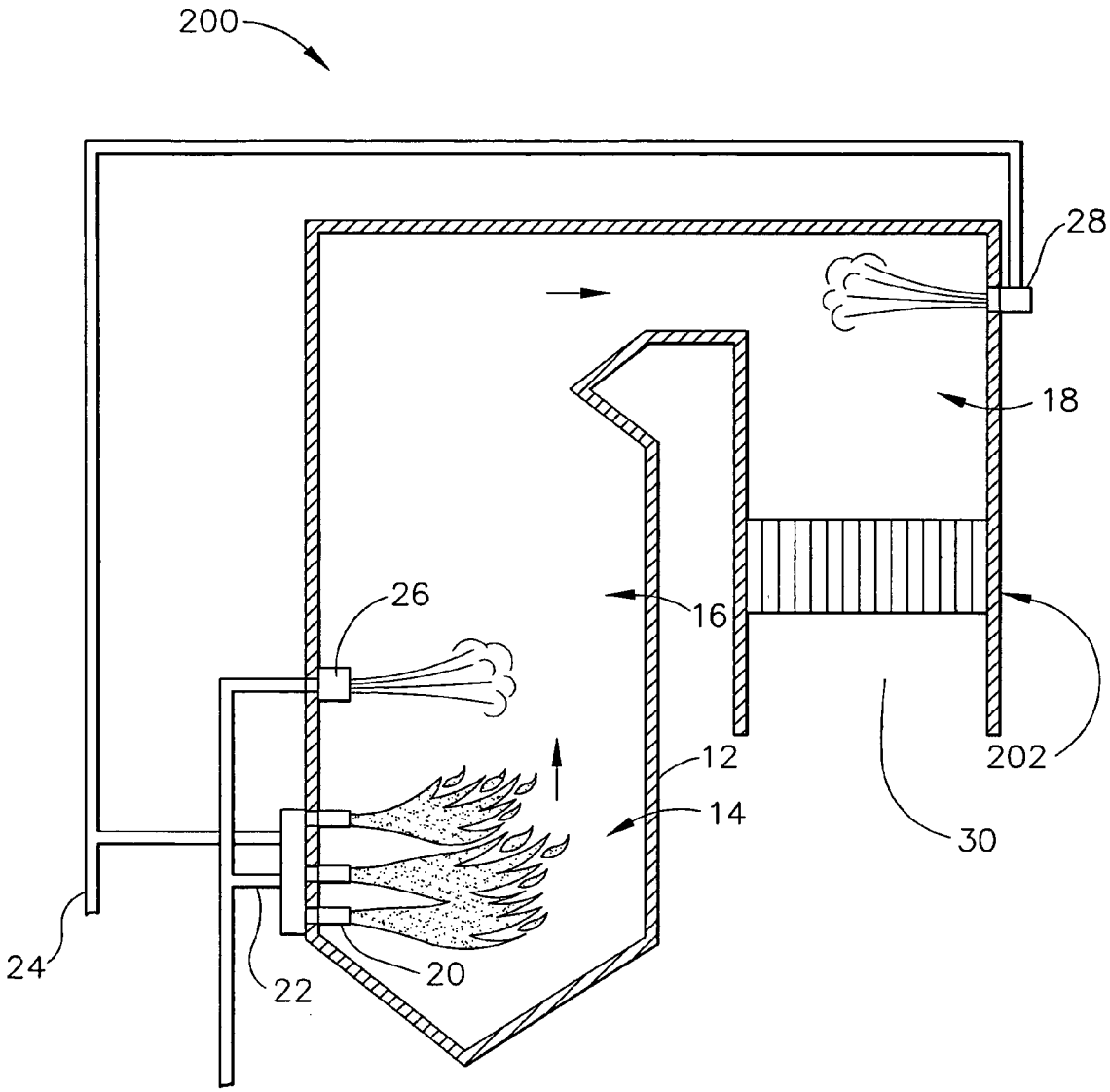
FIG. 2 is a schematic view of a second exemplary power generating boiler furnace system.

FIG. 2 is a schematic view of a second exemplary power generating boiler furnace system 200. In the exemplary embodiment, a concentration of NO may be reduced in a three-step process. In a first step, reburning fuel 26 may be injected to provide fuel-rich environment in which NO is partially reduced to $N_2$. In a second step, OFA may be injected downstream of reburn zone 16 in a predetermined temperature range that results in a NO reduction by N-containing species formed in reburn zone 16. In a third step, combustion flue gas containing CO, remaining NO, and un-reacted N-containing species may be directed through an oxidation catalyst 202. CO is oxidized by catalyst 202 while N-containing species are partially oxidized and partially reduced to $N_2$.

Figure 3:
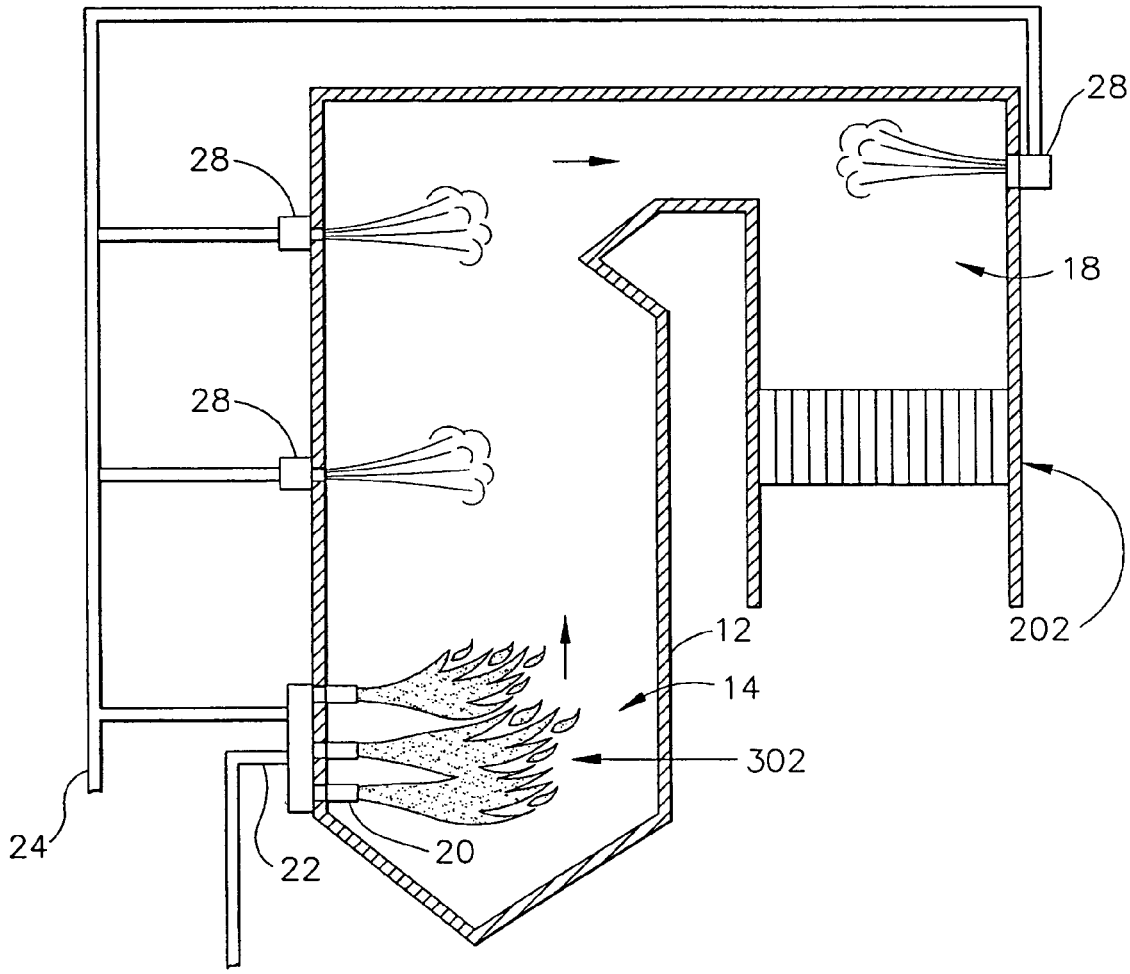
FIG. 3 is a schematic view of another exemplary power generating boiler furnace system.

FIG. 3 is a schematic view of another exemplary power generating boiler furnace system 300. The exemplary embodiment represents air staging wherein reburning fuel is not injected, and a fuel rich zone 302 is formed by fuel-rich combustion in main combustion zone 14. One or more additional OFA ports 28 may be used to stage the introduction of OFA to match conditions in furnace 12 at any time. Each of the additional OFA ports 28 may be independently controlled such that a OFA air flow may be modulated over a wide flow rate range as well as being substantially shut-off. As in other embodiments of the in-situ-AR process, the conditions may be selected to approximately meet $[NH_3]+[HCN]=[NO_x]$ at the point of OFA injection to facilitate optimizing $NO_x$ removal. In the exemplary embodiment, oxidation catalyst 202 is used. In an alternative embodiment, oxidation catalyst 202 is not used.

Figure 4:
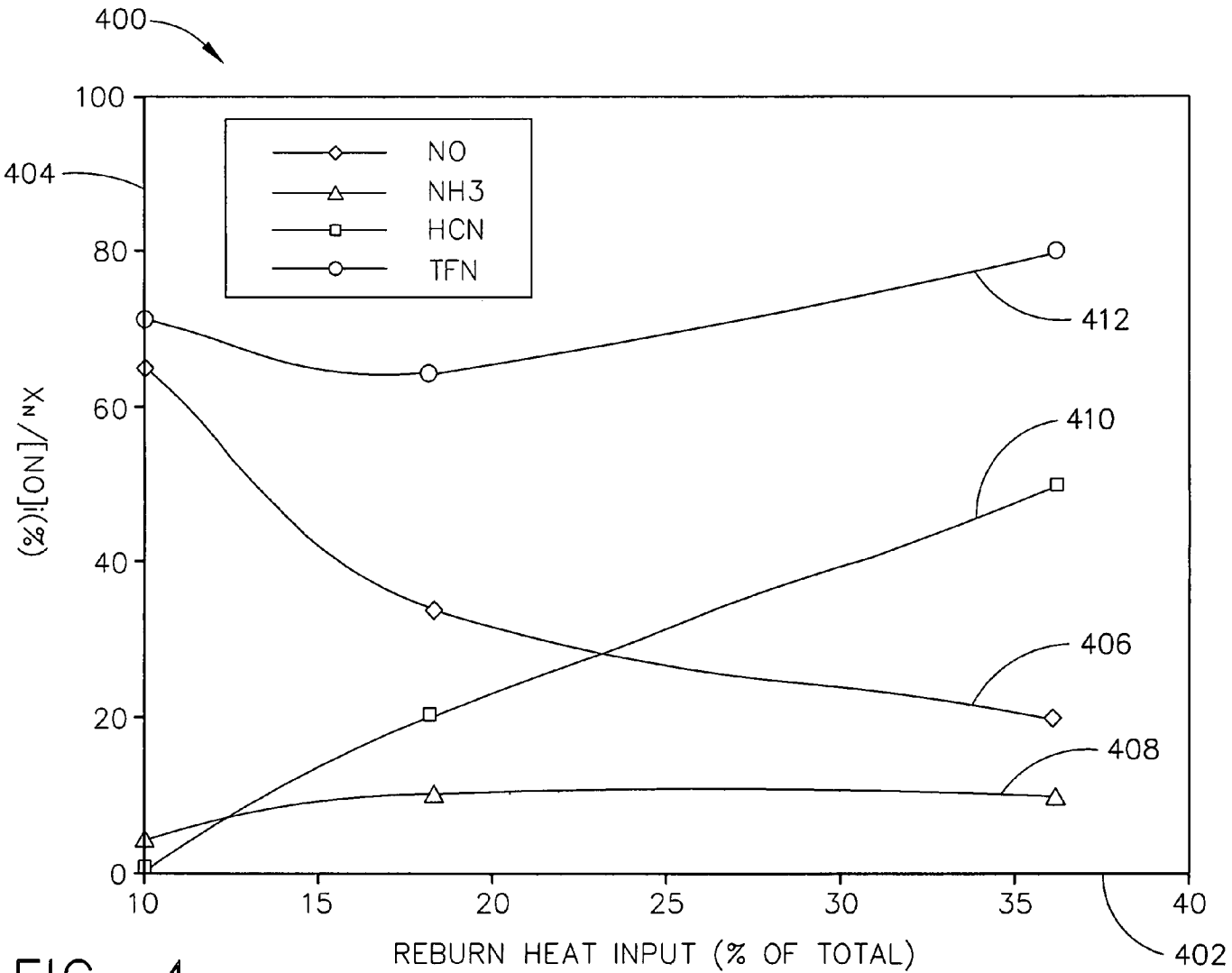
FIG. 4 is a graph illustrating exemplary traces of relative concentrations of N-containing species during operation of a furnace in accordance with the embodiment shown in FIG. 1.

FIG. 4 is a graph 400 illustrating exemplary traces of relative concentrations of N-containing species during operation of a furnace in accordance with the embodiment shown in FIG. 1. Graph 400 includes an x-axis 402 graduated in units of reburning fuel input as a percentage of the total heat input into the furnace. A y-axis 404 is graduated in percentage units of $X_N/[NO]_i$ wherein $X_N$ represents a total concentration of N-containing species before reburning fuel injection and $[NO]_i$ represents an initial NO concentration measured without reburning fuel injection. A trace 406 represents a concentration of NO. A trace 408 represents a concentration of $NH_3$. A trace 410 represents a concentration of HCN, and a trace 412 represents a concentration of total fixed nitrogen (TFN). During operation, concentrations of NO, $NH_3$, HCN and TFN were measured in furnace 12 while being fired on natural gas. TFN, as used herein is defined as a sum of NO, $NH_3$, and HCN. In the exemplary embodiment, reburning fuel, for example, natural gas, and OFA were injected at locations where flue gas temperatures were 2500° F. and 2200° F., respectively. The concentrations of NO, $NH_3$, and HCN were measured at the end of reburn zone 16 (before OFA injection). Traces 406, 408, 410, and 412 illustrate NO, $NH_3$, HCN and TFN as fractions of total concentration of N-containing species before reburning fuel injection. $NH_3$ and HCN are formed in reburn zone 16 as a result of reactions between $CH_i$ radicals and NO.

Trace 406 illustrates that NO concentration at the end of reburn zone 16 depends on a relative heat input of the reburning fuel and decreases as relative heat input of the reburning fuel increases. For the range of relative heat inputs illustrated, the concentrations of $NH_3$, trace 408, and HCN, trace 410 at the end of reburn zone 16 are considered. The TFN concentration, trace 412, at the end of reburn zone 16 is minimized at approximately 18% reburning fuel input. For the exemplary fuels and process conditions and 18% reburning fuel heat input, NO concentration, trace 406 at the end of reburn zone 16 is approximately equal to a sum of $NH_3$ and HCN concentrations.

Figure 5:
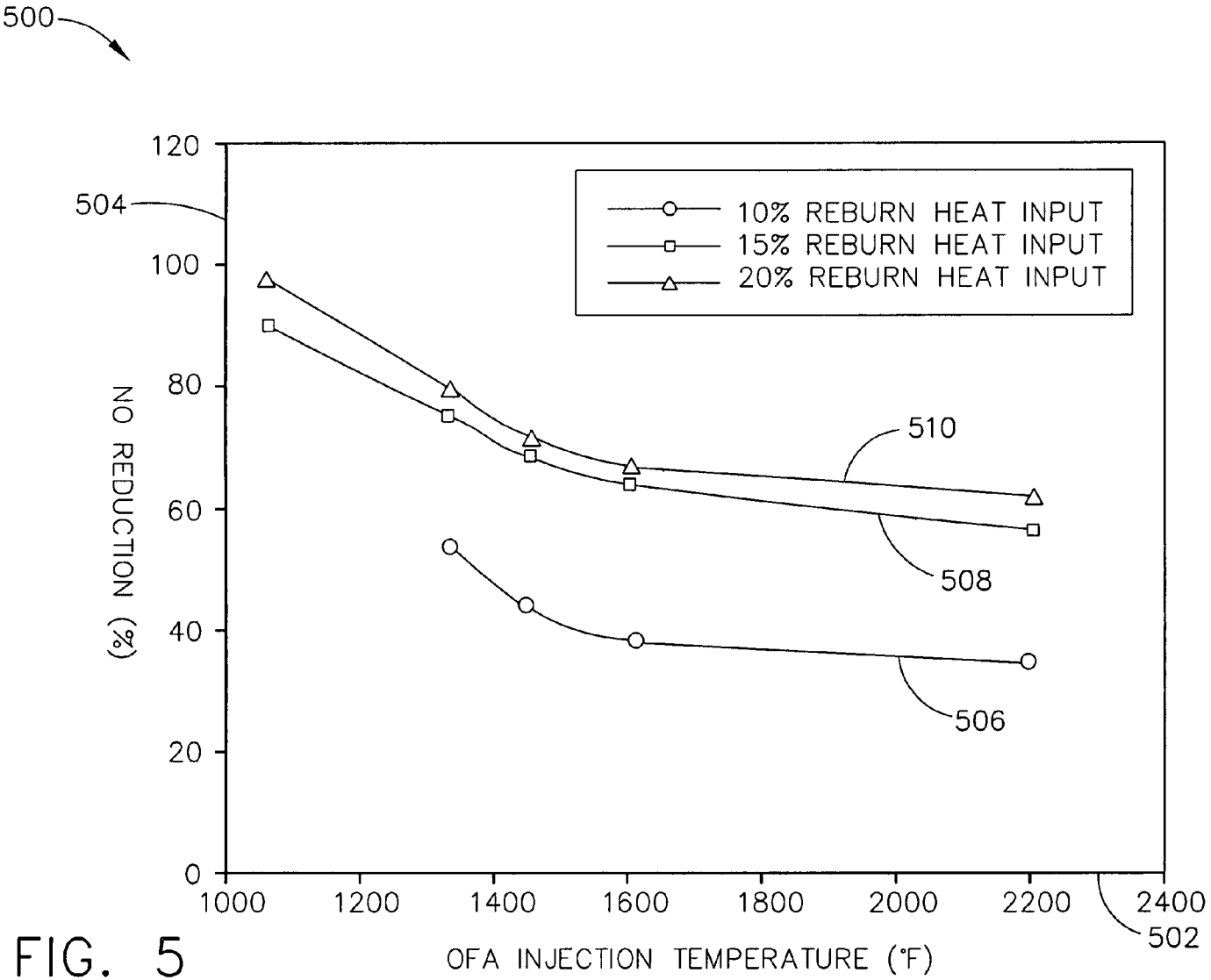
FIG. 5 is a graph illustrating exemplary traces of NO concentration as a function of temperature $T_{OFA}$ of the flue gas at a point where overfire air is injected using the system shown in FIG. 1.

FIG. 5 is a graph 500 illustrating exemplary traces of NO concentration as a function of temperature $T_{OFA}$ of the flue gas at a point where overfire air is injected using system 10 (shown in FIG. 1). Graph 500 includes an x-axis 502 graduated in divisions of ° F. and a y-axis 504 graduated in divisions of percent NO reduction. A trace 506 illustrates the NO concentration with an amount of reburning fuel of about 10% heat input. A trace 508 illustrates the NO concentration with an amount of reburning fuel of about 15% heat input. A trace 510 illustrates the NO concentration with an amount of reburning fuel of about 20% heat input. In the exemplary embodiment, $NO_i$ was 310 ppm at 0% $O_2$. Natural gas was used as main combustion fuel and reburning fuel. As illustrated, NO reduction increased as $T_{OFA}$ decreased at each of the exemplary heat inputs. The increase in NO reduction is approximately linear as $T_{OFA}$ decreases from 2200° F. to about 1600° F. This improvement in NO reduction may be due to an increased residence time in reburn zone 16. Further temperature decrease to lower than 1600° F. resulted in a relatively greater increase in NO reduction efficiency. NO reduction for a 15% reburning at $T_{OFA}$ of approximately 1050° F. to approximately 1150° F. reached approximately 90% and NO reduction for a 20% reburning at $T_{OFA}$ of approximately 1050° F. to approximately 1150° F. reached approximately 95%.

Figure 6:
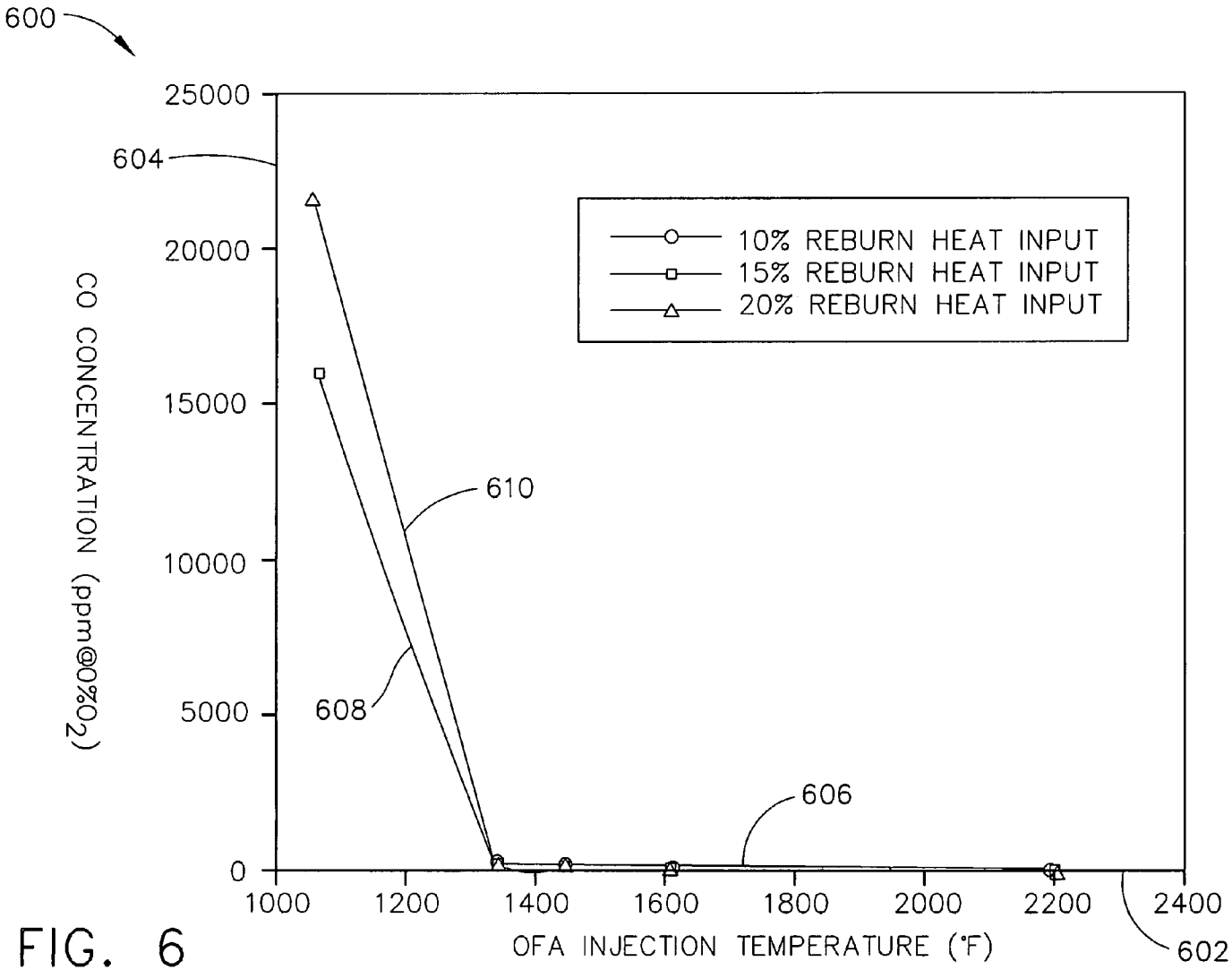
FIG. 6 is a graph illustrating exemplary traces illustrating an effect of $T_{OFA}$ on CO emissions.

FIG. 6 is a graph 600 illustrating exemplary traces demonstrating an effect of $T_{OFA}$ on CO emissions. Graph 600 includes an x-axis 602 divided in graduations of ° F. and a y-axis 604 divided into units of parts per million (PPM) CO concentration at zero percent $O_2$. Trace 606 illustrates CO concentration at 10% reburning heat input. Trace 608 illustrates CO concentration at 15% reburning heat input. Trace 610 illustrates CO concentration at 20% reburning heat input. The CO emissions illustrated by traces 606, 608, and 610 are less than 15 ppm at $T_{OFA}$ above 1350° F. and sharply increase at lower temperatures. The sharp increase in CO concentration at relatively low temperature may be a consequence of low temperature chemistry of CO oxidation that occurs relatively slowly such that CO oxidation is not completed within an amount of time available in the OFA zone. Accordingly, operation demonstrates that OFA injection in the temperature range of approximately 1050° F. to approximately 1150° F. results in an NO reduction of up to 95%. However, CO oxidation in this temperature range may be incomplete.

Figure 7:
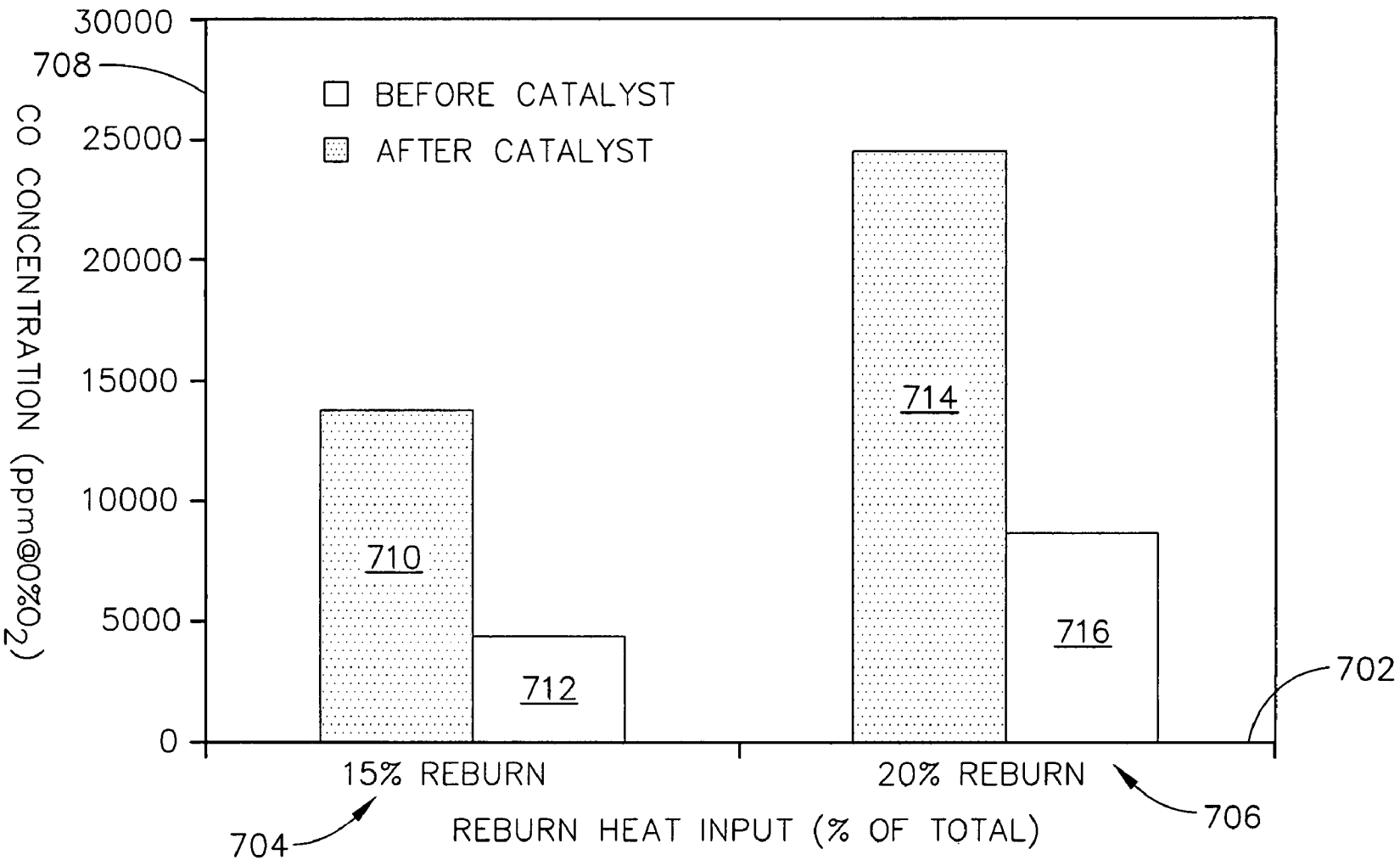
FIG. 7 is a graph illustrating a relationship between reburning heat input and CO concentration on an inlet side of the oxidation catalyst and an outlet side of the oxidation catalyst.

FIG. 7 is a graph 700 illustrating a relationship between reburning heat input and CO concentration on an inlet side of oxidation catalyst 202 and an outlet side of oxidation catalyst 202. Graph 700 includes a x-axis 702 that is divided into a 15% reburning portion and a 20 reburning portion 706, and an y-axis 708 that is divided into graduations of CO concentration in ppm at 0% $O_2$. A temperature of the combustion flue gas at the catalyst location was approximately 500° F. During operation with approximately 15% reburning, a bar 710 illustrates a CO concentration of approximately 14,000 ppm upstream of catalyst 202 and a bar 712 illustrates a CO concentration of approximately 4,500 ppm after the combustion flue gas has passed through catalyst 202. During operation with 20% reburning, a bar 714 illustrates a CO concentration of approximately 25,000 ppm upstream of catalyst 202 and a bar 716 illustrates a CO concentration of approximately 8,500 ppm after the combustion flue gas has passed through catalyst 202. As illustrated CO emissions significantly decrease as a result of CO oxidation across catalyst 202. A more efficient CO oxidation can be achieved with lower space velocity through the catalyst.

The results above illustrate that significant concentrations of $NH_3$ and HCN may be present in reburn zone 16. These species may react with NO and may facilitate substantially reducing NO emissions. A greater reduction in NO concentration may be realized when OFA is injected at combustion flue gas temperatures of approximately 1050° F. to approximately 1750° F. Because CO oxidation at lower temperatures of this range may not be complete, installation of downstream oxidation catalyst 202 may facilitate complete oxidation of CO.

Figure 8:
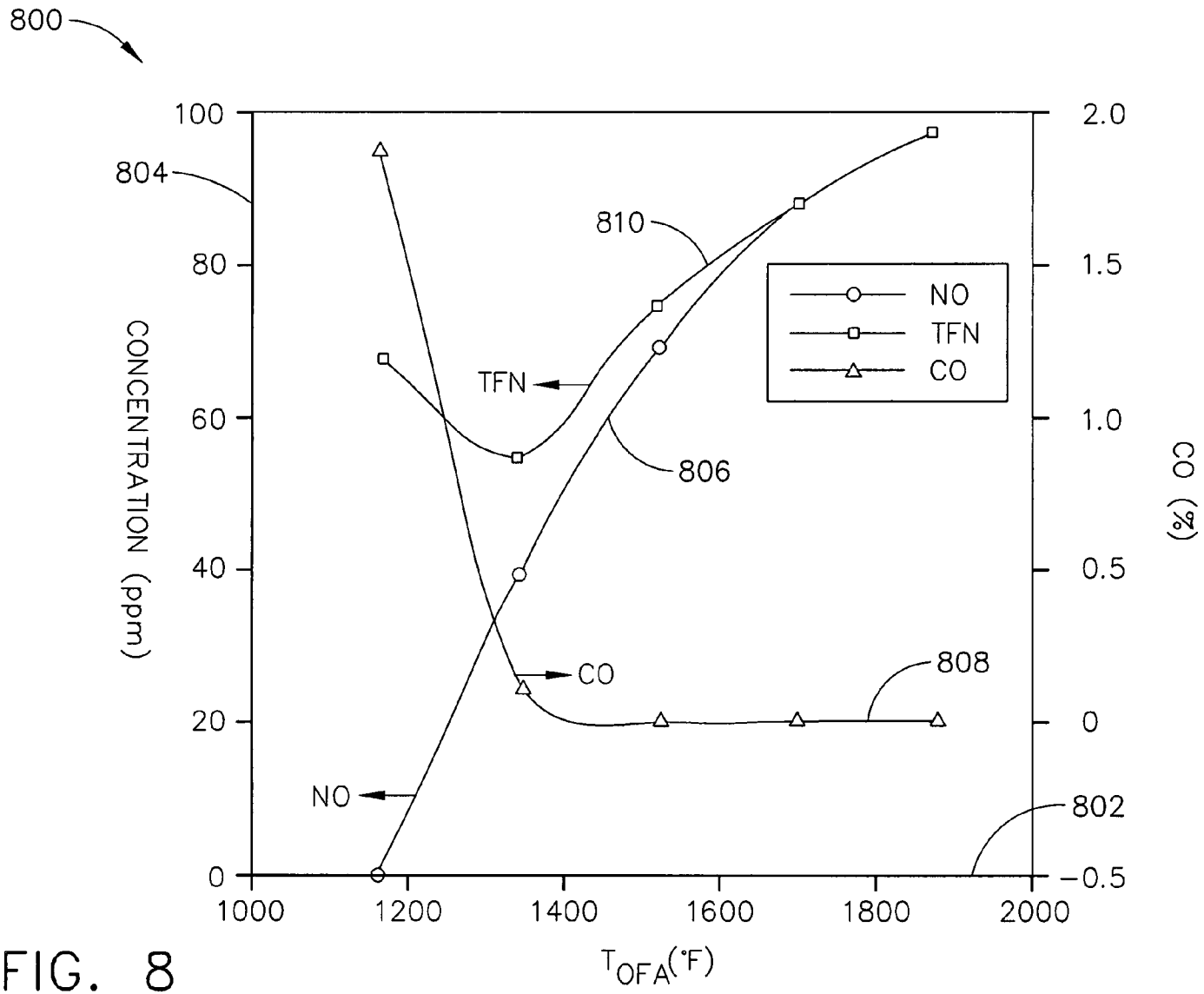
FIG. 8 is a graph that illustrates a prediction of an effect of $T_{OFA}$ on NO, total fixed nitrogen (TFN), and CO concentrations at the end of a burnout zone.

FIG. 8 is a graph 800 that illustrates a prediction of an effect of $T_{OFA}$ on NO, TFN, and CO concentrations at the end of burnout zone 18. Graph 800 includes a x-axis 802 divided in graduations of an injection temperature of OFA and an y-axis 804 that is divided in graduations of reagent concentration in units of ppm. A process model may be used to predict $NO_x$ control efficiency. The process model was developed to include a detailed kinetic mechanism of natural gas reburning combined with gas dynamic parameters characterizing mixing of reagents. Process modeling facilitates understanding the effects of system components and conditions on $NO_x$ control performance. In modeling, a set of homogeneous reactions representing the interaction of reactive species was assembled. Each reaction was assigned a certain rate constant and heat release or heat loss parameters. A plurality of numerical solutions of differential equations for time-dependent concentrations of the reagents facilitates predicting the concentration-time curves for all reacting species under selected process conditions. During modeled operation, the process conditions that facilitate significant improvements in $NO_x$ removal may be determined.

The chemical kinetic code ODF, for "One Dimensional Flame" (Kau, C. J., Heap, M. P., Seeker, W. R., and Tyson, T. J., Fundamental Combustion Research Applied to Pollution Formation. U.S. Environmental Protection Agency Report No. EPA-6000/7-87-027, Volume IV: Engineering Analysis, 1987), was employed to model experimental data. ODF is designed to progress through a series of well-stirred or plug-flow reactors, solving a detailed chemical mechanism. The kinetic mechanism (Glarborg, P., Alzueta, M. U., Dam-Johansen, K., and Miller, J. A., Combust. Flame 115: 1–27 (1998)) consisted of 447 reactions of 65 C—H—O—N chemical species.

The model was used to predict $NO_x$ reduction in natural gas reburning as a function of flue gas temperature at which OFA was injected ($T_{OFA}$). Initial $NO_x$ (NOi) and the amount of reburning fuel were assumed to be 300 ppm and 18%, respectively. This amount of the reburning fuel was chosen for modeling because, as illustrated in FIG. 4, at 18% reburning heat input, NO concentration in the combustion flue gas at the end of reburn zone 16 is approximately equal to the sum of $NH_3$, and HCN. This resulted in a nitrogen stoichiometric ratio (NSR) of 1.0. As used herein, NSR is defined as a molar ratio of $NH_3$+HCN to NO. Modeling was conducted for the final excess $O_2$ after OFA injection of 3%, which may be typical for industrial boilers. The temperature of the combustion flue gas decreased at a substantially linear rate of approximately 550° F. per second, which may also be typical for industrial boilers.

Process model output graph 800 includes a trace 806 that illustrates a prediction of NO concentration in the combustion flue gas decreasing as $T_{OFA}$ decreases. This NO reduction may be due to reactions of NO with $NH_3$ and HCN. These reactions are similar to reactions that take place in a SNCR process. Optimum temperatures for the SNCR process are in the range of approximately 1750° F. to approximately 1950° F. without significant amounts of combustibles present in flue gas and decrease as CO concentration in flue gas increases. At temperatures higher than optimum some $NH_3$ and HCN may be oxidized and form NO. At temperatures lower than optimum not all $NH_3$ and HCN are consumed in reactions with NO and $O_2$ resulting in "ammonia slip".

A trace 808 illustrates a model prediction of CO concentration in flue gas at the end of reburn zone 16 at 18% reburning fuel heat input is about 2%. Optimum temperatures for the SNCR process at this CO concentration are in the range of approximately 1300° F. to 1400° F. A trace 810 of the model prediction illustrates that TFN reaches a minimum at a $T_{OFA}$ of about 1350° F. Although NO continued to be reduced further at temperatures below approximately 1350° F., not all $NH_3$ and HCN were consumed in this process resulting in an increase in TFN.

Trace 808 illustrates a model prediction that CO was substantially completely oxidized to CO2 at a $T_{OFA}$ in a range of approximately 1350° F. to approximately 1900° F. The CO concentration in the combustion flue gas increased as $T_{OFA}$ decreased below approximately 1350° F. This may be due to low temperature CO oxidation becoming too slow and may not be substantially completed within time available in burnout zone 18.

Trace 810 illustrates a model prediction of OFA injection of approximately 1350° F. resulted in TFN reduction from 300 ppm to about 60 ppm. CO is substantially completely oxidized at $T_{OFA}$ of approximately 1350° F. and greater. When compared to empirical results the model results illustrated in graph 800 exhibited a close correlation.

It is contemplated that the benefits of the various embodiments of the invention accrue to all combustion systems, such as, for example, but not limited to, a stoker furnace, a fluidized bed furnace, and a cyclone furnace.

The above-described nitrogen oxide reducing methods and systems provide a cost-effective and reliable means for reducing nitrogen oxide concentration in combustion flue gas emissions without injecting N-reducing agents into the combustion flue gas stream. More specifically, empirical results show that significant concentrations of $NH_3$ and HCN can be present in the reburn zone. These species may react with NO and significantly reduce NO emissions if OFA is injected at combustion flue gas temperatures of about 1050° F. to about 1750° F. Because CO oxidation at lower temperatures of this range is not complete, installation of a downstream oxidation catalyst may permit complete CO oxidation. Accordingly, controlling process conditions that promote the formation of N-containing agents and injecting OFA at temperatures in a range that facilitates the combination of $NH_3$ and NO to form $N_2$ provides a cost-effective methods and systems for reducing nitrogen oxide emissions.

While the invention has been described in terms of various specific embodiments, those skilled in the art will recognize that the invention can be practiced with modification within the spirit and scope of the claims.

What is claimed is:

1. A method for reducing nitrogen oxides in combustion flue gas comprising:

firing a furnace to generate a main combustion zone, a fuel rich zone, and combustion flue gas containing nitrogen oxides and reduced N-containing species;

injecting over-fire air into the combustion flue gas from at least one location wherein a ratio of a molar concentration of reduced N-containing species in the combustion flue gas to the molar concentration of nitrogen oxides in the combustion flue gas is in the range of approximately 0.5 to approximately 2.0 at the over-fire air injection location; and injecting a reburning fuel in a reburn zone.

2. A method in accordance with claim 1 wherein injecting over-fire air into the combustion flue gas from at least one location comprises injecting over-fire air into the combustion flue gas from at least one location such that the ratio of the molar concentration of reduced N-containing species in the combustion flue gas to the molar concentration of nitrogen oxides in the combustion flue gas is in the range of approximately 0.8 to approximately 1.2 at the over-fire air injection location.

3. A method in accordance with claim 1 further comprising measuring the concentration of at least one of $NH_3$, HCN, and $NO_x$ in the combustion flue gas.

4. A method in accordance with claim 3 wherein measuring the concentration of at least one of $NH_3$, HCN, and $NO_x$ in the combustion flue gas comprises using the measured concentration of the at least one of $NH_3$, HCN, and $NO_x$ to facilitate optimizing the reduction of nitrogen oxides.

5. A method in accordance with claim 1 wherein firing a furnace to generate a main combustion zone and a fuel rich zone comprises combusting a main combustion fuel in a main combustion zone.

6. A method in accordance with claim 1 wherein injecting over-fire air into the combustion flue gas comprises injecting over-fire air at an exhaust gas temperature of about 1050 degrees Fahrenheit to about 1750 degrees Fahrenheit.

7. A method in accordance with claim 6 wherein injecting over-fire air into the combustion flue gas comprises injecting over-fire air at an exhaust gas temperature of about 1150 degrees Fahrenheit to about 1500 degrees Fahrenheit.

8. A method for reducing nitrogen oxides in combustion flue gas, said method comprising:

combusting a fuel in a main combustion zone such that a flow of combustion flue gas is generated, said gas comprising at least one nitrogen oxide species;

adding a reburning fuel to the flow of combustion flue gas downstream from the main combustion zone to establish a fuel-rich zone;

forming a plurality of reduced N-containing species in the fuel rich zone;

injecting a flow of over-fire air into the flow of combustion flue gas to form an over fire air zone downstream of the fuel rich zone; and controlling process parameters to provide conditions for the reduced N-containing species to react with the nitrogen oxides in the over-fire air zone to produce elemental nitrogen such that a concentration of nitrogen oxides is reduced and such that a molar concentration of reduced N-containing species is facilitated to be maintained approximately equal to the molar concentration of nitrogen oxides when the combustion flue gas reaches the over fire air zone.

9. A method in accordance with claim 8 wherein establishing a fuel-rich zone comprises establishing the fuel-rich zone within the main combustion zone.

10. A method in accordance with claim 8 wherein injecting over-fire air into the combustion flue gas comprises injecting over-fire air into the combustion flue gas at an exhaust gas temperature in a range of between about 900 degrees Fahrenheit to about 2800 degrees Fahrenheit.

11. A method in accordance with claim 8 wherein injecting over-fire air into the combustion flue gas comprises injecting over-fire air into the combustion flue gas at an exhaust gas temperature in a range of between about 1050 degrees Fahrenheit to about 1750 degrees Fahrenheit.

12. A method in accordance with claim 8 wherein injecting over-fire air into the combustion flue gas comprises injecting over-fire air into the combustion flue gas at an exhaust gas temperature in a range of between about 1150 degrees Fahrenheit to about 1500 degrees Fahrenheit.

13. A method in accordance with claim 8 wherein controlling process parameters comprises controlling process conditions in the main combustion zone and the fuel-rich zone to maintain the ratio of molar concentration of reduced N-containing species to the molar concentration of nitrogen oxides in the range of approximately 0.5 to approximately 2.0 when the combustion flue gas reaches location of over-fire air injection.

14. A method in accordance with claim 8 wherein controlling process parameters comprises controlling process conditions in the main combustion zone and the fuel-rich zone to maintain the ratio of molar concentration of reduced N-containing species to the molar concentration of nitrogen oxides in the range of approximately 0.8 to approximately 1.2 when the combustion flue gas reaches location of over-fire air injection.

15. A method in accordance with claim 8 wherein injecting over-fire air into the combustion flue gas comprises injecting over-fire air into the combustion flue gas at a plurality of locations.

16. A method in accordance with claim 15 wherein injecting over-fire air into the combustion flue gas comprises controlling the injection of over-fire air into the combustion flue gas to maintain the molar concentration of reduced N-containing species approximately equal to the molar concentration of nitrogen oxides when the combustion flue gas reaches each of the plurality of over-fire air locations.

17. A method in accordance with claim 8 wherein forming a plurality of reduced N-containing species comprises forming a plurality of reduced N-containing species including at least one of $NH_3$ and HCN.

18. A method in accordance with claim 8 wherein combusting a main combustion fuel in a main combustion zone comprises combusting at least one of coal, natural gas, oil, biomass, municipal waste products, and industrial waste products in the main combustion zone.

19. A method in accordance with claim 8 further comprising injecting a reburning fuel into the flow of combustion flue gas downstream of the main combustion zone such that a fuel rich zone is created, the combustion flue gas including a concentration of nitrogen oxides.

20. A method in accordance with claim 19 wherein injecting a reburning fuel into the flow of combustion flue gas comprises injecting at least one of coal, products of gasification of coal, natural gas, oil, biomass, municipal waste products, and industrial waste products into the flow of combustion flue gas.

21. A method in accordance with claim 8 further comprising generating carbon monoxide in the combustion fuel gas.

22. A method in accordance with claim 21 wherein concentration of generated carbon monoxide affects a temperature range in which nitrogen oxides react with the reduced N-containing species.

23. A method in accordance with claim 8 further comprising providing an oxidation catalyst to facilitate reducing a concentration of carbon monoxide (CO) in the combustion flue gas.

24. A combustion system comprising:

a main combustion zone for combusting a fuel;

a fuel rich zone located downstream from said main combustion zone;

at least one over-fire air port for injecting over-fire air into a combustion flue gas stream at a respective over-fire air zone;

a catalyst zone for reducing a concentration of carbon monoxide in said combustion gas stream; and a controller configured to control process conditions in the main combustion zone and the fuel rich zone such that a molar concentration of reduced N-containing species is approximately equal to a molar concentration of $NO_x$ when the combustion flue gas reaches said over-fire air zone.

25. A combustion system in accordance with claim 24 wherein said controller is configured to control process conditions in the main combustion zone and the fuel rich zone such that a ratio of molar concentration of reduced N-containing species to the molar concentration of nitrogen oxides is in the range of approximately 0.8 to approximately 1.2 when the combustion flue gas reaches location of over-fire air injection location.

26. A combustion system in accordance with claim 24 wherein said main combustion zone is configured for fuel rich combustion such that said fuel rich zone is generated by fuel rich combustion in said main combustion zone.

27. A combustion system in accordance with claim 24 further comprising a reburn zone wherein a reburning fuel is injected into said combustion flue gas stream to generate a fuel rich zone downstream of said main combustion zone.

28. A combustion system in accordance with claim 24 wherein said controller facilitates controlling at least one over-fire air port.

29. A combustion system in accordance with claim 24 wherein said controller is configured to control over-fire injection temperature to a temperature of about 1050 degrees Fahrenheit to about 1750 degrees Fahrenheit.

30. A combustion system in accordance with claim 29 wherein said controller is configured to control a temperature at the over-fire air injection location to a temperature of about 1150 degrees Fahrenheit to about 1550 degrees Fahrenheit.

31. A combustion system in accordance with claim 24 configured to combust at least one of coal, products of gasification of coal, natural gas, oil, biomass, municipal waste products, and industrial waste products into the flow of combustion flue gas.

* * * * *

UNITED STATES PATENT AND TRADEMARK OFFICE

CERTIFICATE OF CORRECTION

PATENT NO. : 7,168,947 B2
APPLICATION NO. : 10/885267
DATED : January 30, 2007
INVENTOR(S) : Zamansky et al.

It is certified that error appears in the above-identified patent and that said Letters Patent is hereby corrected as shown below:

In Claim 8, column 10, line 25, after “nitrogen oxide” delete “species”.

Signed and Sealed this

Fourteenth Day of July, 2009

JOHN DOLL
*Acting Director of the United States Patent and Trademark Office*